US005772424A

United States Patent [19]

Nokelainen

[11] Patent Number: 5,772,424

[45] Date of Patent: Jun. 30, 1998

[54] CANDLE COMPRISING A FORM PIECE AND A SHIELD ELEMENT

[75] Inventor: Erkki Nokelainen, Ikaalinen, Finland

[73] Assignee: Heikki Nokelainen, Tampere, Finland

[21] Appl. No.: 696,989

[22] PCT Filed: Feb. 16, 1995

[86] PCT No.: PCT/FI95/00075

§ 371 Date: Sep. 30, 1996

§ 102(e) Date: Sep. 30, 1996

[87] PCT Pub. No.: WO95/22716

PCT Pub. Date: Aug. 24, 1995

[30] Foreign Application Priority Data

Feb. 17, 1994 [FI] Finland ..... 940741

[51] Int. Cl.[6] ..... F23D 3/02

[52] U.S. Cl. ..... 431/291; 362/162; 229/155; 229/162; 229/185

[58] Field of Search ..... 362/161, 162, 362/163, 266; 431/298, 320, 324, 291, 288; 229/155, 162, 185

[56] References Cited

U.S. PATENT DOCUMENTS

| | | | |
|---|---|---|---|
| 618,275 | 1/1899 | Kerr | 362/162 |
| 932,772 | 8/1909 | Fleck | 362/162 |
| 4,734,833 | 3/1988 | Schneeberger . | |
| 4,907,140 | 3/1990 | Overstreet . | |
| 5,264,996 | 11/1993 | Bele, Jr. et al. . | |

FOREIGN PATENT DOCUMENTS

| | | | |
|---|---|---|---|
| 40088 | 5/1968 | Finland . | |
| 397048 | 8/1933 | United Kingdom | 362/161 |

*Primary Examiner*—James C. Yeung
*Attorney, Agent, or Firm*—Pollock, Vande Sande & Priddy

[57] ABSTRACT

A candle comprises a formed piece manufactured of a meltable material, a burning wick placed inside the formed piece, and a shield element covering the formed piece and provided with an opening in the upper edge of the candle in its position of use. The shield element includes an upper part and a lower part, the upper part being connected with the lower part, and extending above the formed piece in the position of use of the candle, and in its non-functional position the upper part of the shield element being placed over at least one of the lower part of the shield element and the wick surface of the formed piece. The upper part of the shield element is formed of at least two pieces which are folded in the non-functional position over at least one of the lower part of the shield element and over the wick surface. The pieces are joined by a joint to the upper edge of the lower part of the shield element, whereby the candle in its non-functional position has substantially the same outer dimensions as the formed piece, and in the functional position of the candle, the upper part of the shield element is placed at the edge of the wick surface.

17 Claims, 8 Drawing Sheets

CANDLE COMPRISING A FORM PIECE AND A SHIELD ELEMENT

FIELD OF THE INVENTION

The present invention relates to a candle comprising a formed piece manufactured of a moltable material, a burning wick placed inside the formed piece and a shield element covering the formed piece and provided with an opening placed in the upper edge of the candle in its position of use. The upper part of the shield element, connected with the lower part of the shield element, is arranged to extend above the form piece in the position of its use.

BACKGROUND OF THE INVENTION

This kind of a candle is substantially known from Finnish Patent No. 40088. The candle is particularly used as a memorial candle on graves. The formed piece manufactured of a melting material is placed, together with wick, inside the shield element, the inner volume of the shield element being larger than the volume of the formed piece. Thus, in the position of use of the candle, a substantially cylindrical free space is left above the formed piece, limited by the upper edge of the shield element, the free space functioning as the flame protecting space of the candle. The shield element is manufactured of a plastic material, and the upper part of the shield element is rigidly connected with the lower part. This results in several disadvantages, particularly in the storing and transporting candles, because their package for transportation and storage requires a relatively large volume, although the candles can be partly placed one within the other. A practical problem in the above-mentioned construction is that it is often difficult to light the wick through the opening in the upper part of the shield element using ordinary lighting means. Furthermore, the shield element of a burnt candle creates an environmental problem, particularly on graveyards, in connection with festival and memorial days, when considerable numbers of candle shield elements must be collected and transported to dumping areas.

As to the prior art in the field, reference is also made to U.S. Pat. No. 4,907,140 and U.S. Pat. No 5,264,996, disclosing shield elements which can be assembled by folding and inside which a separate candle can be placed.

SUMMARY OF THE INVENTION

The purpose of this invention is to provide a candle whereby the disadvantages and problems of the prior art can be eliminated to a large extent and the prior art can thus be improved in the field. The candle according to the invention has a considerably larger number of uses than e.g. a candle according to Finnish Patent No. 40088. Consequently, one purpose of the invention is to provide also new applications for candle lighting in addition to use on a graveyard. The candle according to the invention can thus be applied in several different uses. To achieve these aims, the candle according to the invention is primarily characterized in that the upper part of the shield element is substantially arranged in the non-functional position of the shield element to be placed over the lower part of the shield element and/or the wick surface of the form piece. Thus the candle in the non-functional position has substantially the same outer dimensions as the formed piece. To make the candle functional, the upper part of the shield element is arranged to be placed at the edge of the wick surface, preferably surrounding the edge. A particularly suitable way to place the shield element in the non-functional position above the surface of the wick of the formed piece is to manufacture the shield element, at least in its substantial parts, of a foldable material, e.g. a cellulose-based material, such as paper, carton and/or plastic, i.e. an environmentally safe, compostable and/or bioabsorbable material suitable for recycling. The shield element can thus be preferably folded and joined in its upper part so that in the functional position of the candle, the upper part of the shield element is formed above the upper edge of the formed piece, so that it functions as a wind shield of the flame and simultaneously as an additional part providing various types of illumination effects, e.g. as a result of color or other treatments, and/or perforations in the material of the shield element.

BRIEF DESCRIPTION OF THE DRAWINGS

In the following description, the invention will be illustrated in more detail with reference to the appended drawings. In the drawings.

DETAILED DESCRIPTION OF THE PREFERRED EMBODIMENT(S)

Figure 1:
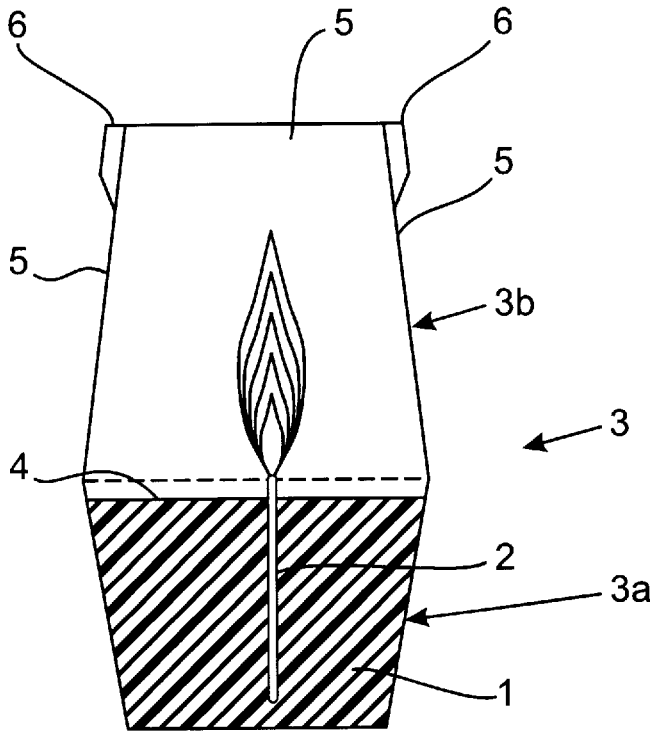
FIG. 1 shows a vertical cross-section of the first embodiment of the candle according to the invention.

With particular reference to FIG. 1, the candle comprises a formed piece 1 made of meltable material, such as stearine, paraffin, wax or the like, with a burning wick 2, e.g. a twisted thread, placed in the vertical direction inside the formed piece 1. The formed piece 1 is substantially covered by a shield element 3 with a lower part 3*a* and an upper part 3*b*. The lower part 3*a* is a cup part with walls and a bottom corresponding to the form of the outer surface of the formed piece 1. The upper edge of the lower part 3*a* is open, whereby the wick surface 4 of the candle, which is horizontal in use, is left inside the shield element 3. The upper part 3*b* of the shield element 3 extends in the position of use of the candle as a substantially cylindrical, or a tubular and substantially vertical extension of the formed piece. The upper part 3*b* of the shield element 3 is advantageously formed of two or more pieces or strips 5. In the embodiment shown in the figure has four strips 5 which are attached to each other by means 6 having preferably the form of joining clips 6*a,* 6*b* (see FIG. 4).

Figure 2:
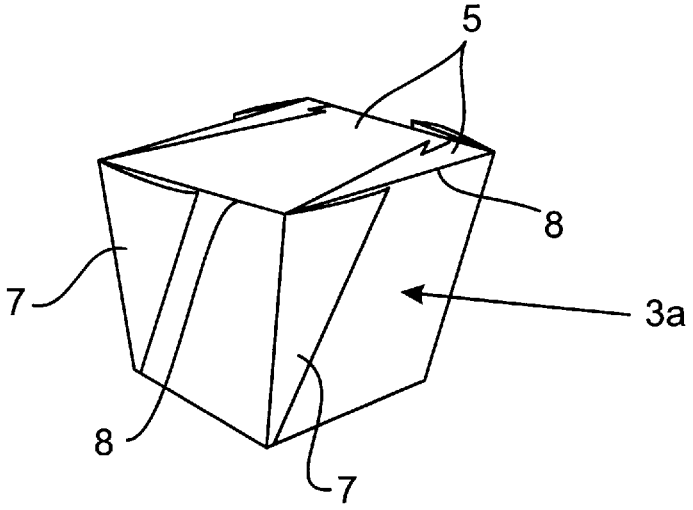
FIG. 2 shows the first embodiment of the candle according to the invention in its non-functional position.

In the basic concept of the invention, in the upper part 3*b* of the shield element, in the non-functional position of the candle as shown in FIG. 2, is arranged to be placed above and over the wick surface 4 of the formed piece 1 so that their main plane coincides with the plane of wick surface 4. In a corresponding manner, FIG. 3 shows the candle in its functional position, whereby the upper part 3*b* of the shield element 3 is arranged to surround the edges of the wick surface 4 substantially in a vertical position when the candle is in use and to surround the formed piece 1.

Figure 3:
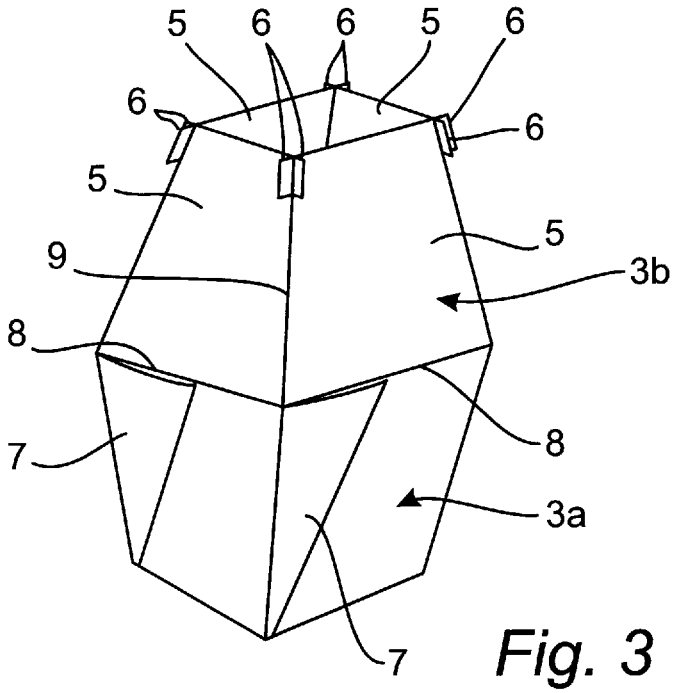
FIG. 3 shows the first embodiment of the candle shown in FIG. 2 brought into its functional position.
Figure 4:
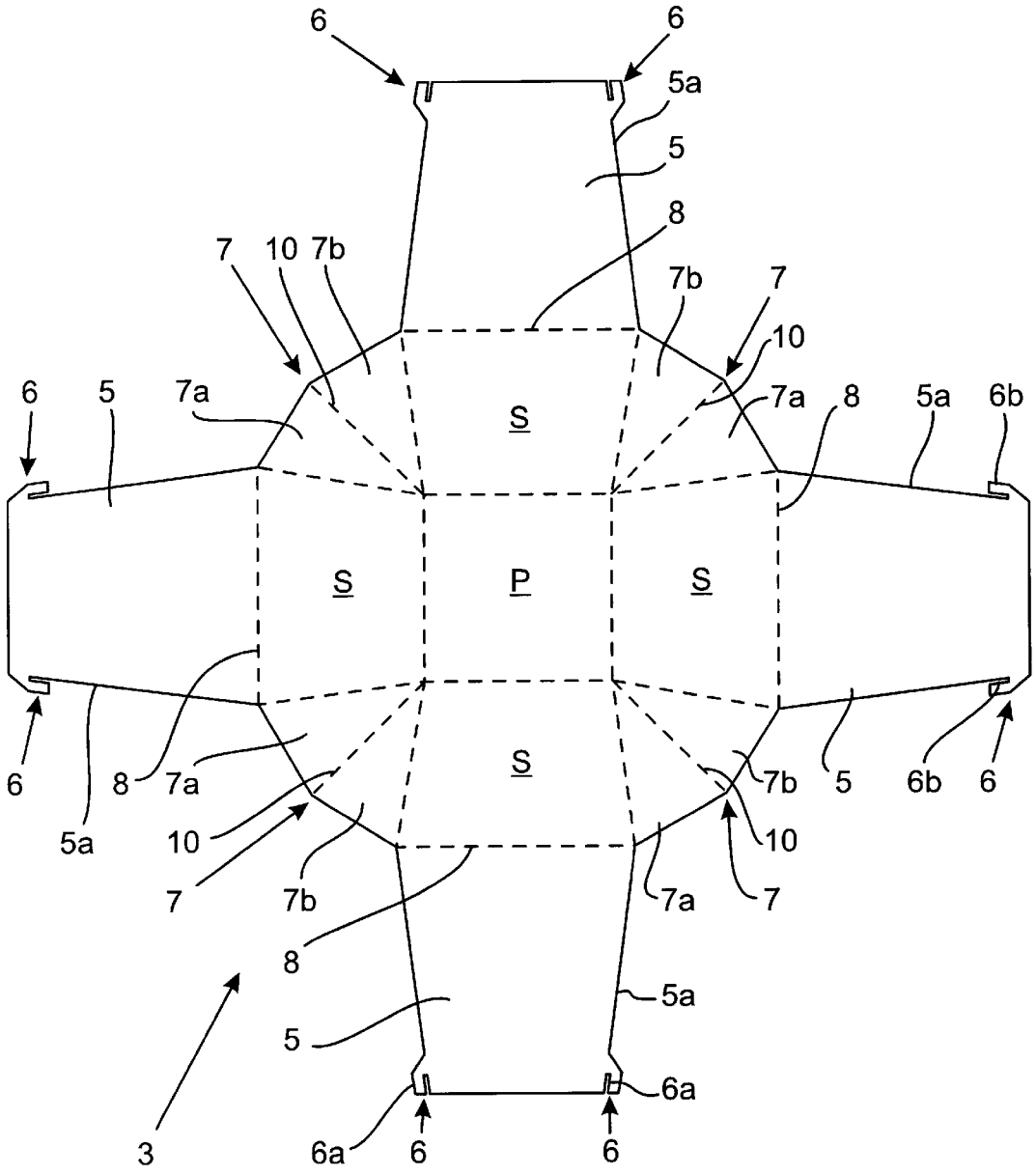
FIG. 4 shows a sectional and folding pattern of the embodiment of the candle shown in FIGS. 1 to 3.

As can be seen from FIGS. 2 and 3, and particularly from FIG. 4, the lower part 3*a* of the shield element 3 is formed by folding, wherein folds 7 are formed in the material of the lower part 3*a* of the shield element 3, either outside and/or inside the lower part 3*a*. The shield element 3 (lower and/or upper part 3*a,* 3*b*) can be provided with perforation or other treatments giving the candle anesthetic impression.

FIG. 3 shows that the means 6 for attaching together the strips 5 forming the upper part of the shield element are placed in connection with the upper edge of the upper part 3*b* of the shield element 3, wherein the edge parts are separated from each other in the section between means 6 and the horizontal upper edge or fold 8 of the lower part 3*a* of the shield element 3, whereby, e.g. in the embodiment shown in FIGS. 1–3, four flow gaps 9 are formed for the flow of air scavenging into the interior of the upper part 3*b* of the shield element 3 between the vertical edge parts 5*a* of each of two adjacent strips 5. Particularly in the embodiment shown in FIG. 3, the strips 5 are arranged to taper towards the upper part of the candle and to have a substantially trapezoidal form.

The attachment of the strips 5 to the upper edge of the lower part 3*a* of the shield element 3 is arranged in the illustrated embodiment by a fold 8 having the length of each side of polygonal form, e.g. quadrangular form, and particularly of square form in the embodiment shown in FIG. 3, of the formed piece 1 as seen in a horizontal cross section.

FIG. 4 shows the sectional and folding pattern of the embodiment shown in FIGS. 1–3, wherein the whole shield element is manufactured of a sheet material by determining the external dimensions of the pattern by cutting and so-called creasing or grooving, whereby a suitable attenuation is provided in the sheet material for making a fold at the respective point. The points of folding, i.e. the points where the material has been treated e.g. by creasing or grooving, are indicated by broken lines in FIGS. 4 and 5. As shown in FIG. 4, the bottom of the shield element 3, i.e. the surface against which the bottom of the form piece 1 is to be placed, has a square form. The bottom is indicated by the letter P in the pattern of FIG. 4. The parts that form the substantially vertical walls at the sides of the formed pieces indicated by the letter S in the pattern, expand towards the upper edge of the formed piece 1, whereby the upper edge or the fold 8 is long than the side of the lower edge of the wall S joining the bottom P. The folds 7 composed of two equilateral triangular parts 7*a,* 7*b,* join the substantially vertical edges of two adjacent walls S and comprise also a central fold 10. The folds can be folded either according to FIGS. 2 and 3 outside and/or inside the lower part 3*a* of the shield element 3. Further, at the point of the fold 8 forming the upper edge of each lower part 3, a part or strip 5 forms a direct extension of the same, comprising further in its free end, at the sides of the edge parts 5*a,* clips 6*a,* 6*b* which are formed in a manner that in adjacent parts or strips 5 are different in a compatible way for the purpose of locking.

Figure 5:
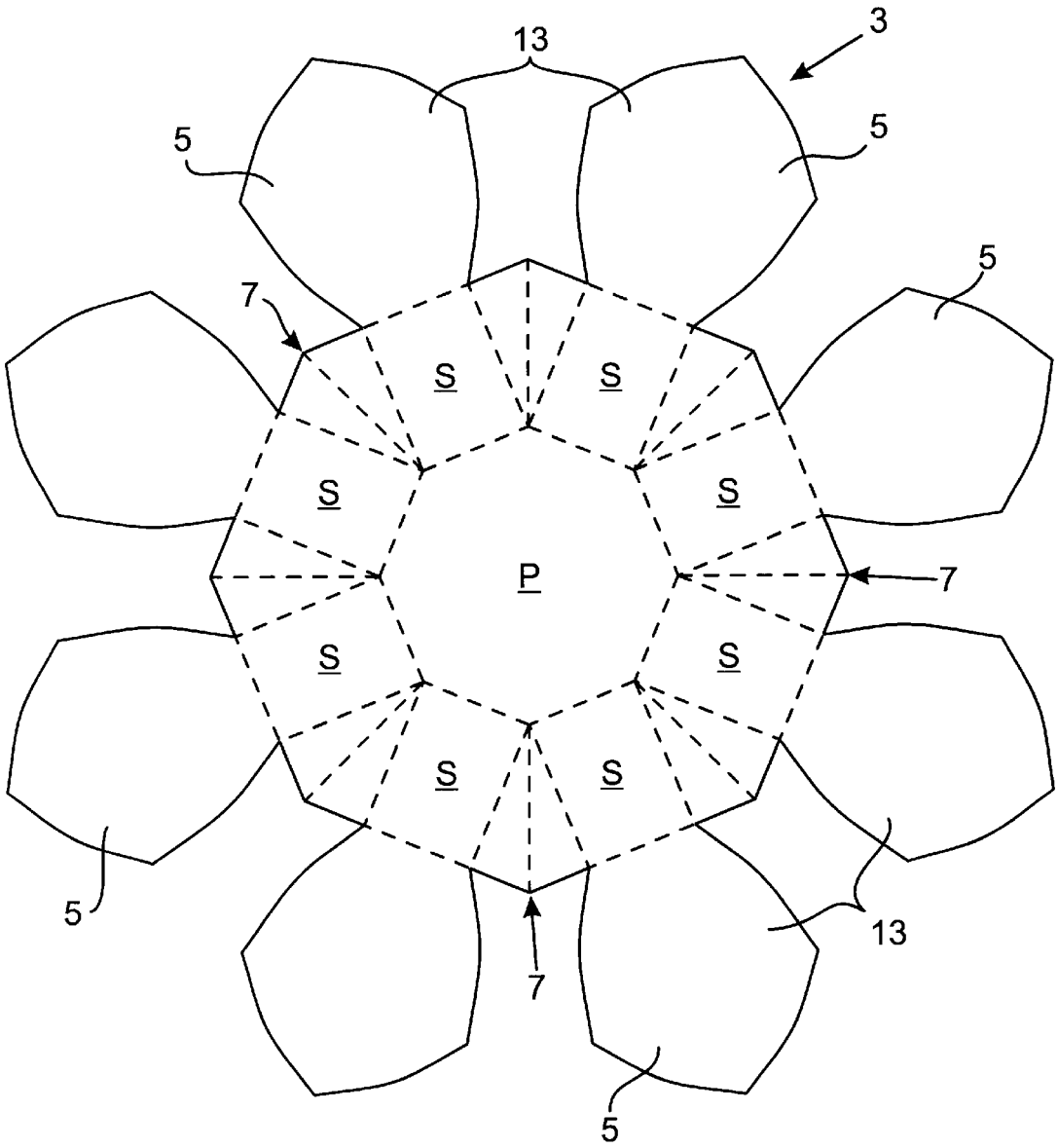
FIG. 5 shows a sectional and folding folding pattern of a shield element to be used in connection with the second embodiment of the candle according to the invention.

FIG. 5 shows a second folding and cutting pattern of the shield element 3 according to the second embodiment of the candle, the form of the bottom P of the shield element being octagonal, wherein also the cross-section of the formed piece 1 is octagonal. In this particular case, the walls S are rectangular and not trapezoidal as in the embodiment shown in FIG. 4. Further, the parts or strips 5 are formed to have a partially curved edge, thus giving in a situation of lighting a special lighting effect when the edge portions of the strip parts are placed to partly overlap (see reference numeral 13). Also the end of the parts or strips 5 is formed to have a sharp edge for providing a lighting effect.

Figure 7:
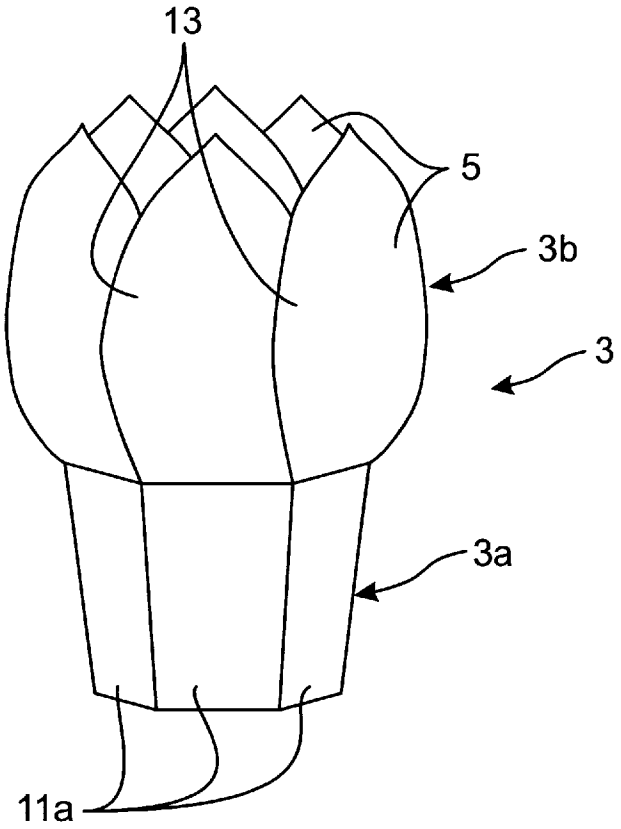
FIG. 7 shows a candle according to the third embodiment of the candle according to the invention, brought into functional position.
Figure 6:
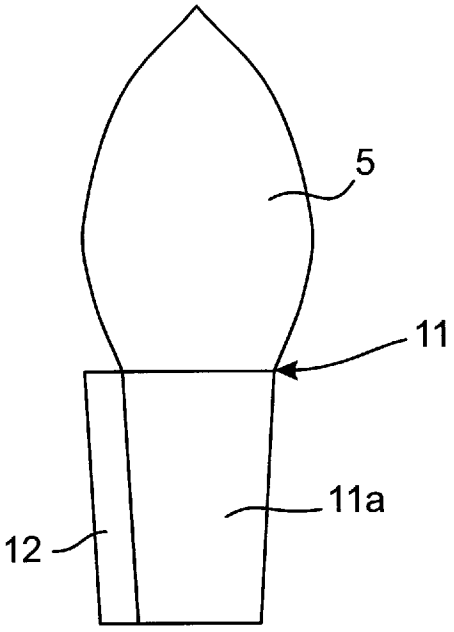
FIG. 6 shows a sectional part of the third embodiment of the candle according to the invention.

FIGS. 6 and 7 show a third embodiment of the candle according to the invention, wherein the shield element 3 is composed of cutting parts 11 shown as an example in FIG. 6, which are glued or joined together. A glueing or joining ribbon 12 for joining the parts 11 is provided at the vertical edge of the parts 11*a* forming the visible surface of the lower part 3*a* of the shield element 3. The embodiment is advantageous in a case when it is desired to have the upper parts 13*b* to overlap as in the embodiment of FIG. 5 (see reference numeral 13, FIG. 7) in the direction of the periphery of the shield element 3, wherein the parts or strips 5 forming the upper part 3*b* are wider than the parts 11*a* forming the lower part 3*a*. The upper part 3*b* can be folded e.g. according to FIG. 2 when the candle is in the non-functional position.

Figure 9:
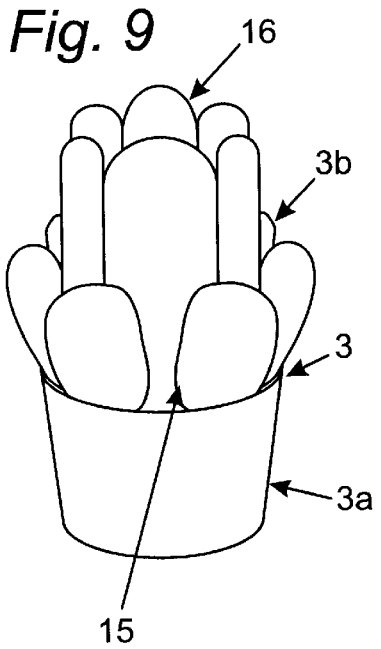
FIG. 9 shows a candle according to the fourth embodiment of the candle according to the invention, in its functional position.
Figure 8:
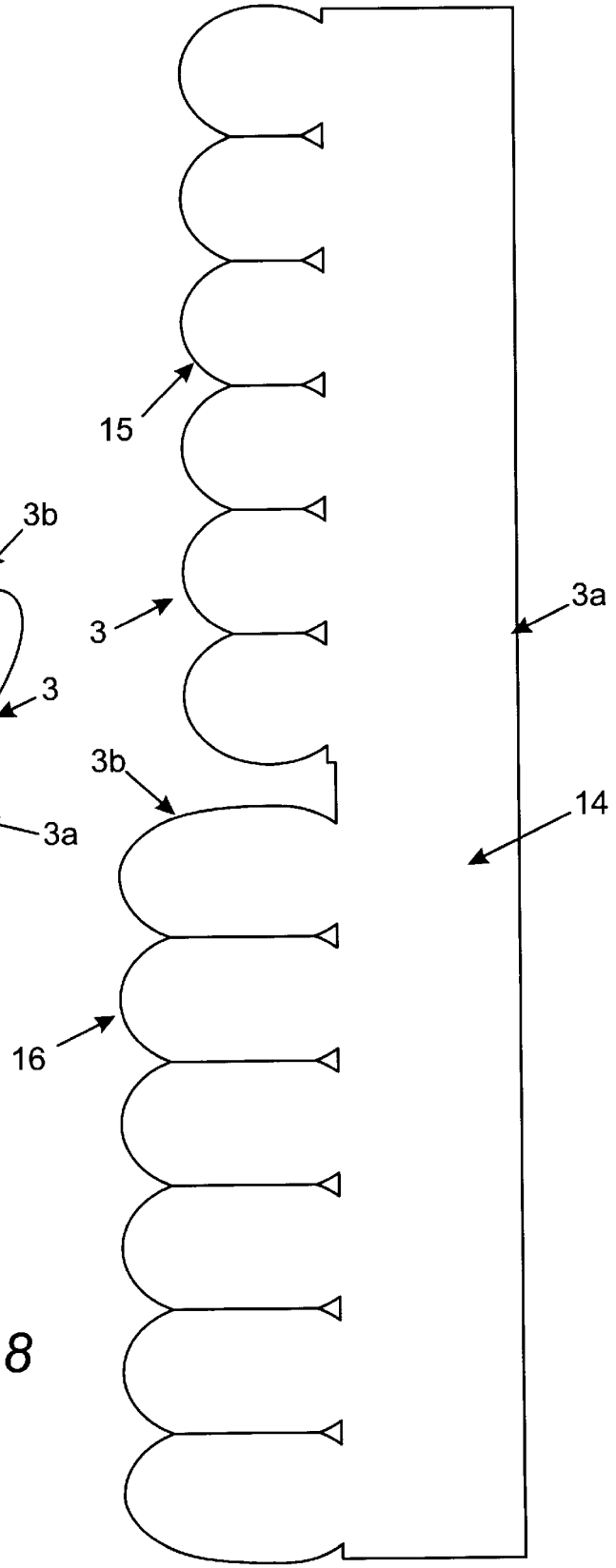
FIG. 8 shows the shield element of a candle according to the fourth embodiment of the candle according to the invention, extended in a plane.
Figure 13:
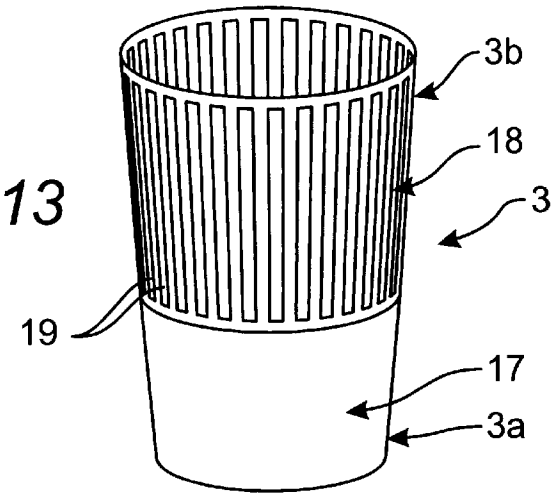
FIG. 13 shows the candle shown in FIG. 12, in its functional position.
Figure 12:
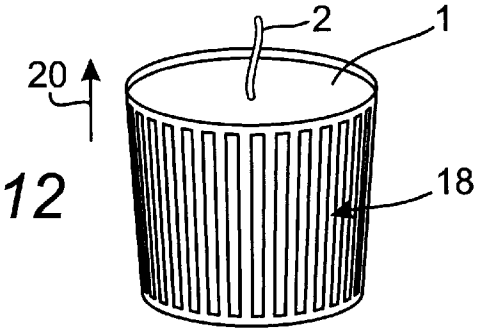
FIG. 12 shows a candle according to the fifth embodiment of the candle according to the invention, in its non-functional position.
Figure 11:
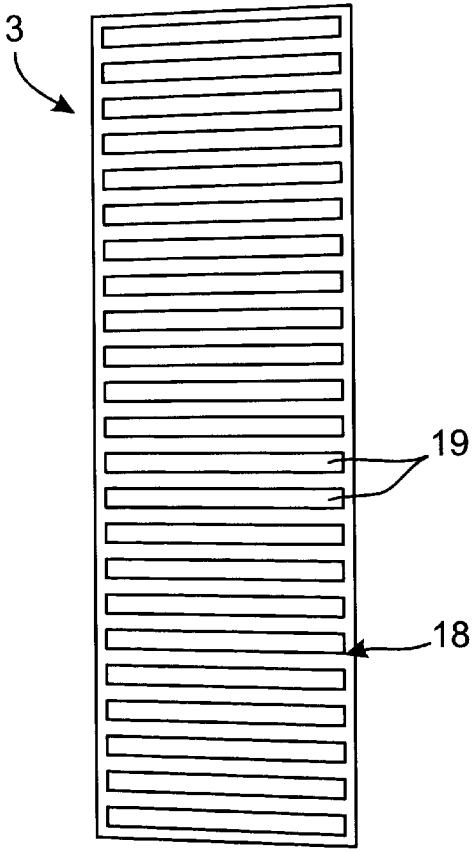
FIGS. 10 and 11 show a shield element according to the fifth embodiment of the candle according to the invention, extended in a plane.
Figure 10:
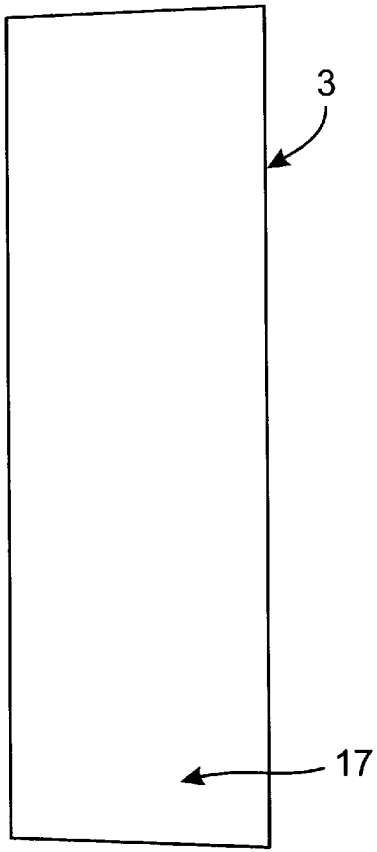
Figure 14:
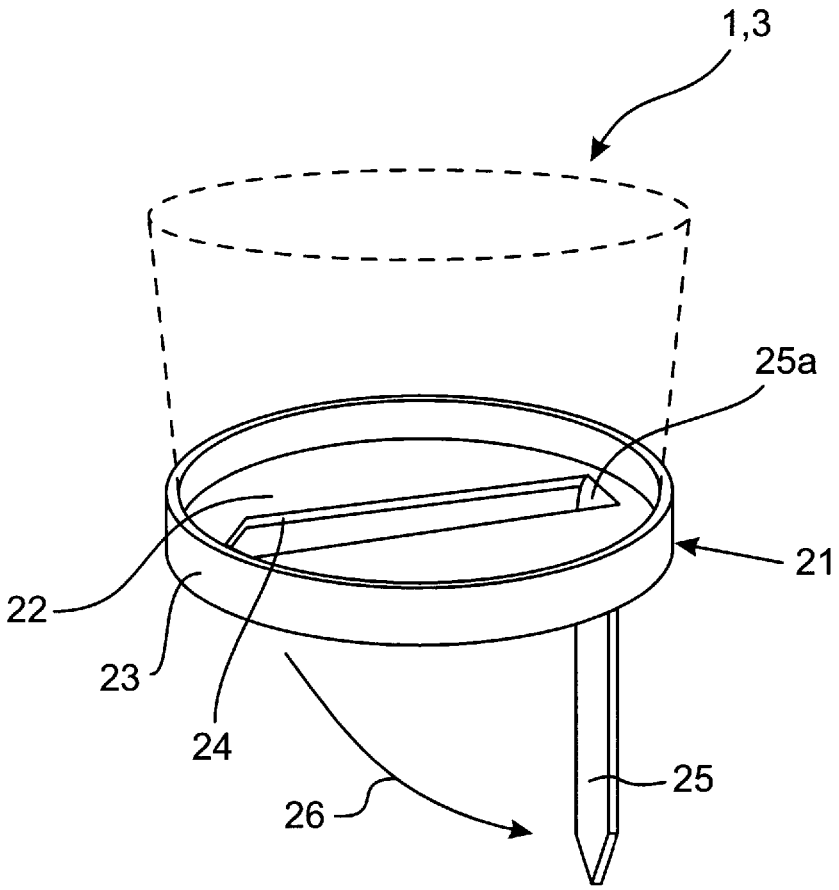
FIG. 14 shows one embodiment of the bottom support for use optionally in connection with at least some embodiments of the candle shown in FIGS. 1 to 13.

FIG. 8 shows a fourth embodiment, wherein a bottom P (FIGS. 4 and 5) is not necessarily required as in FIGS. 6 and 7, or the bottom can be manufactured of a separate piece (see FIG. 14). The shield element 3 is manufactured of a cut strip element 14 which is made of a suitably foldable sheet material so that the total length of the strip element 14 is substantially twice the circumference of the formed piece 1 or another multiple of the circumference. The strip element 14 can thus be wrapped as a cover part twice around the outer surface of the formed piece, as shown in FIG. 9. The upper part 3*b* of the shield element 3 consists of two parts, an outer upper part 15 and an inner outer part 16 which can have different sizes and formed e.g. to give an aesthetic impression as shown in FIG. 9, wherein the upper part 3*b* of the shield element 3 comprises two or several layers. The upper part 3*b* can be folded e.g. according to FIG. 2, candle being in its non-functional position.

FIGS. 10 to 13 show a fifth embodiment of the candle according to the invention. The shield element 3 comprises thus two separate rectangular strip elements 17 and 18, which are wrapped as shown in FIG. 9 on the formed piece 1 on top of each other, separate from each other. The outer strip element 18, forming the upper part 3*b* of the shield element 3, can be provided with a special shape, a perforation pattern 19 or e.g., a corresponding treatment for giving an aesthetic impression. The annular outer strip part 18 forming the upper part 3*b* is lifted at the formed piece 1 to the upper position in the direction of arrow 20, wherein the annular strip element 17 forming the lower part 5*a* underneath the strip part 18 is exposed. The strip element 18, which can also be provided with treatments, e.g. perforations giving aesthetic impressions, is not higher than the formed piece 1.

FIG. 14 shows in a perspective view the bottom support 21 which can be used in connection with the candle especially when the candle is used outdoors. The bottom support 21 comprises a bottom element 22, the shape and size of which corresponds to that of the horizontal cross-section of the bottom of the candle. The edge of the bottom element 22 is provided with an upwardly projecting wall element 23 or the like, thus providing a supporting space for the bottom of the candle in the horizontal direction. The bottom element 22 is further provided with a cutting or perforation 24 for accomplishing one or multiple shapes for projecting elements. By pressing the area of cutting or perforation 24, at least one projecting element, such as a spike 25, can be brought, if the conditions for the use of the candle so require, to a vertical position from the horizontal position determined by the bottom element 22 as shown with an arrow 26 in FIG. 14. The projecting element, such as the spike 25 which is fixed from the base 25*a* to the bottom element 22, can be pressed into a soft underground and thus the candle is firmly fixed to the ground, the bottom element 22 being against the ground. The bottom support 21 can be manufactured of steel or light metal, such as aluminium alloy.

It is advantageous that the material of the shield element 3, particularly when it is cellulose-based, is at least partly impregnated with a vegetable oil, a wood-based oil, a natural oil, color, food coloring agent, or the like, particularly for making the material non-combustible, non-flammable and/or non-incineratable.

One important advantage of the invention is present when the material used for the shield element is environmentally safe, i.e. compostable, incineratable, reusable or in some other way suitable for recycling.

I claim:

1. A candle comprising:

a formed piece manufactured of a meltable material, a burning wick placed inside the formed piece, and a shield element covering the formed piece and provided with an opening in the upper edge of the candle in its position of use, the shield element including an upper part and a lower part, said upper part being connected with said lower part, and extending above the formed piece in the position of use of the candle, and in its non-functional position the upper part of the shield element being placed over at least one of the lower part of the shield element and the wick surface of the formed piece, the upper part of the shield element being formed of at least two pieces which are folded in the non-functional position over at least one of the lower part of the shield element and over the wick surface, said pieces being joined by a joint to the upper edge of the lower part of the shield element, whereby the candle in its non-functional position has substantially the same outer dimensions as the formed piece, and in the functional position of the candle, the upper part of the shield element is placed at the edge of the wick surface.

2. A candle according to claim 1, wherein the formed piece, as seen in a transverse cross-sectional view, has a polygonal form, and the upper part of the shield element is formed of pieces having substantially the length of the respective side of the polygon at said joint.

3. A candle according to claim 1, wherein said joint is a fold at the upper edge of the lower part of the shield element.

4. A candle according to claim 2, wherein said joint is a field at the upper edge of the lower part of the shield element.

5. A candle according to claim 1, wherein the shield element further includes several cutting parts which are joinable with means for connecting the cutting parts and form the lower part of the shield element, wherein the pieces forming the upper part of the shield element are wider than the cutting parts that form the lower part of the shield element.

6. A candle according to claim 1, wherein the shield element is formed of at least one strip element wrapped at least once around the formed piece.

7. A candle according to claim 1, wherein the upper part of the shield element comprises at least two sections which have differently shaped pieces and which form a layered structure.

8. A candle according to claim 1, wherein the adjacent pieces forming the upper part are joined by joining means at the edge portions of the pieces placed next to each other when the candle is in its functional position.

9. A candle according to claim 8, wherein said joining means form joining clips, and are placed at least at the upper edge of the upper part of the shield element.

10. A candle according to claim 9, wherein vertical edge portions of the pieces are separated from each other between said joining means and the horizontal upper edge of the lower part of the shield element, whereby a flow gap is formed for the flow of air scavenging the interior of the upper part of the shield element between the vertical edge parts of each two adjacent pieces.

11. A candle according to claim 1, wherein the shield element is at least partly manufactured of a cellulose-based material, by cutting.

12. A candle according to claim 11, wherein a cutting pattern is provided with creases or grooves, to permit assembling of the shield element by folding.

13. A candle according to claim 1, wherein the material of the shield element is at least partly impregnated by one of a vegetable oil, a wood-based oil, a natural oil, a colorant, a food coloring agent for making the material non-combustible, non-flammable and/or non-incineratable.

14. A candle according to claim 1, wherein the shield element is at least partly provided with perforations.

15. A candle according to claim 1, wherein the lower part of the shield element is formed by folds arranged in the material of the lower part and wherein at least some of the folds are placed in assembling of the lower part, at the sides of the walls of the lower part, either outside the candle or inside the lower part.

16. A candle according to claim 1, wherein the pieces forming the upper part of the shield element taper towards the upper part at least at their ends and are provided with a perforation.

17. A candle according to claim 1, wherein the upper part forms a layered structure with said pieces having different shapes.

* * * * *